US007299107B2

(12) United States Patent
Lin et al.

(10) Patent No.: US 7,299,107 B2
(45) Date of Patent: Nov. 20, 2007

(54) METHOD FOR ANALYZING EFFECTIVE POLISHING FREQUENCY AND EFFECTIVE POLISHING TIMES FOR CHEMICAL MECHANICAL PLANARIZATION POLISHING WAFERS WITH DIFFERENT POLISHING PAD PROFILES

(75) Inventors: Zone-Ching Lin, Taipei (TW); Chein-Chung Chen, Chungli (TW)

(73) Assignee: National Taiwan University of Science and Technology, Taipei (TW)

( * ) Notice: Subject to any disclaimer, the term of this patent is extended or adjusted under 35 U.S.C. 154(b) by 224 days.

(21) Appl. No.: 11/286,341

(22) Filed: Nov. 25, 2005

(65) Prior Publication Data

US 2006/0240745 A1 Oct. 26, 2006

(30) Foreign Application Priority Data

Apr. 20, 2005 (TW) ..... 94112618 A

(51) Int. Cl.
*G06F 19/00* (2006.01)

(52) U.S. Cl. ..... 700/121; 700/164

(58) Field of Classification Search ..... 216/38, 216/52, 89; 340/539.1; 438/633, 692, 959; 700/110, 121, 125, 159, 160, 164
See application file for complete search history.

(56) References Cited

U.S. PATENT DOCUMENTS 6,685,543 B2 2/2004 Lai et al.

*Primary Examiner*—Leo Picard
*Assistant Examiner*—Carlos Ortiz-Rodriguez
(74) *Attorney, Agent, or Firm*—Rosenberg, Klein & Lee

(57) ABSTRACT

A method for analyzing polishing frequency and number of polishing times for chemical planarization polishing wafer with different polishing pad profiles is disclosed. First, drawings of a wafer and a polishing pad are provided and then are converted into pixel arrays. Pixel arrays are processed to be black/white images. The black/white images are converted into binary matrices. The effective polishing frequencies of all points in the binary matrix are calculated. Following the calculated polishing frequencies, the coordinates of all binary matrices are redefined according to a displacement condition, and then new coordinates of all points and corresponding effective numbers of polishing times for a time increment are calculated so as to form an effective polishing times matrix for the time increment. Further, all effective numbers of polishing times within a total polishing time interval are added together.

17 Claims, 10 Drawing Sheets

Fig. 2A

Set a center of the wafer as an origin of a new coordinate system — 112a

Translate the wafer and the polishing pad to unite coordinates of the binary matrices in the new united coordinate system — 112a

Fig. 2B

Calculate new wafer binary matrix values $Nwafer(i', j')$ and new polishing pad binary matrix values $Npad(i', j')$ for at least a time increment $\Delta t$ — 116a Calculate an effective number of polishing times for a point displacing from $(i, j)$ to $(i', j')$, expressed as:
$FT(i', j') = Npad(i', j') \times Nwafer(i', j') \times F(i, j) \times \Delta t$
where $Npad(i', j') \times Nwafer(i', j') = 0$ or 1, and $F(i, j)$ is the polishing frequency — 116b Calculate effective numbers of polishing times for all points for at least a time increment to form an effective polishing times matrix $\lfloor FT'_{i'j'} \rfloor_{P \times Q}$,
programmed as:

```
for i = 1 to P
    for j = 1 to Q
  FT(i', j') = Npad(i', j') × Nwafer(i', j') × F(i, j) × Δt
    next j
next i
```

— 116c

Transform the coordinate of the effective polishing times matrix $\lfloor FT'_{i'j'} \rfloor_{P \times Q}$ for at least a times increment back into a starting coordinate to obtain a starting effective polishing times matrix $\lfloor FT_{k(ij)_k} \rfloor_{P \times Q}$ for the at least a time increment $\Delta t$ — 116d

| polishing pad profile | Diameter of wafer (in) | Diameter of abrasive particle D(nm) | Time increment $\Delta t$ (sec) | rotating speed ratio: wafer/polishing pad (rpm/rpm) | Total polishing time interval (sec) |
|---|---|---|---|---|---|
| Circular | 12 | 50 | 0.033 | 25/25 | 180 |
| Elliptic | 12 | 50 | 0.033 | 25/25 | 180 |
| Triangular | 12 | 50 | 0.033 | 25/25 | 180 |

Fig. 6

METHOD FOR ANALYZING EFFECTIVE POLISHING FREQUENCY AND EFFECTIVE POLISHING TIMES FOR CHEMICAL MECHANICAL PLANARIZATION POLISHING WAFERS WITH DIFFERENT POLISHING PAD PROFILES

RELATED APPLICATIONS

The present application is based on, and claims priority from, Taiwan Application Serial Number 94112618, filed Apr. 20, 2005, the disclosure of which is hereby incorporated by reference herein in its entirety.

BACKGROUND

1. Field of Invention

The present invention relates to a method for analyzing a polishing frequency and a number of polishing times. More particularly, the present invention relates to a method for analyzing an effective polishing frequency and an effective number of polishing times for chemical mechanical planarizing a wafer with different polishing pad profiles.

2. Description of Related Art

Chemical mechanical planarization (CMP) is a global planarization technique which employs both of a mechanical polishing by polishing media and a chemical polishing by chemical solution to remove particles on a wafer surface so that subsequent processes such as deposition and etching are successful. As global planarization is a basic requirement for multilevel interconnects and CMP is recognized as a feasible way to globally planarize a wafer, CMP is very commonly used in semiconductor processes.

In the conventional planarization analyzing technique for a wafer processed by CMP, a finite element method is often used for evaluating a pressure field distribution during polishing. A speed distribution can be obtained from relative velocity between any point on the wafer and a polishing pad, derived by a relative rotating speed. There are also experimental efforts to derive a relation between a speed distribution and a removal rate.

In a typical CMP method, the speed distribution is evaluated under a condition of a planet path and an identical rotating speed for the wafer and the polishing pad. In the case of other relative rotating speeds, an averaged speed distribution is often used. As to compensating chemical mechanical wafer polishing with the wafer disposed above the pad, if the planet path is employed and the wafer and the polishing pad have an identical rotating speed, a distribution of a number of polishing times on the wafer surface is uneven due to the polishing pad incompletely covering the wafer, so that a good planarization cannot be obtained.

Unfortunately, evaluation of the relative speed is based on complex principles and has the following difficulties. Evaluation of the speed for compensating chemical mechanical planarization involves complicated integration, and evaluation of the number of polishing times is difficult, especially for a non-circular polishing pad.

Implementation of global planarization detection is also difficult. For an ordinary chemical mechanical wafer polishing, certain measurement positions on which an endpoint detector measures are selected indirectly. For compensating chemical mechanical wafer polishing, although the polishing surface of the wafer faces upward, which helps a direct measurement during polishing, the available number of measurement positions is still limited and the global planarization detection is not easily achieved because global planarization effect is related to an effective polishing frequency or an effective number of polishing times of all points on the wafer.

For the foregoing reasons, a method for analyzing the effective polishing frequency and the effective number of polishing times for chemical mechanical wafer polishing is needed, providing a reference to the distribution of the effective number of polishing times after chemical mechanical wafer polishing for a period of time.

SUMMARY

It is therefore an objective of the present invention to provide a method for analyzing polishing frequency and the number of polishing times of a wafer surface for evaluating an effective polishing frequency and an effective number of polishing times by an ordinary CMP or a compensating CMP.

It is another objective of the present invention to provide a method for analyzing polishing frequency and the number of polishing times of a wafer surface for evaluating an effective polishing frequency and an effective number of polishing times of a wafer surface with different polishing pad profiles and different relative speeds.

It is another objective of the present invention to provide a method for analyzing polishing frequency and the number of polishing times of a wafer surface for evaluating an effective polishing frequency and an effective number of polishing times of a wafer surface when a polishing pad acts upon the wafer along an planet path.

It is another objective of the present invention to provide a method for analyzing polishing frequency and the number of polishing times of a wafer surface for predicting an unevenness of a wafer surface, possibly from an uneven polishing frequency, and lowering a detecting range needed for an endpoint detection.

In accordance with the foregoing and other objectives of the present invention, a method for analyzing a polishing frequency and the number of polishing times of a wafer surface is provided. In a preferred embodiment, the method includes providing drawings of a polishing pad and a wafer; converting the drawings into respective pixel arrays; processing the pixel arrays to be black/white images; converting the black/white images into numeric matrices; and converting the numeric matrices into binary matrices. Then, the origin is located at upper left corner (0,0), as shown in FIG. 1B.

The method further comprises redefining coordinates of the binary matrices, which includes setting the coordinate of the wafer center as an origin (0,0) of a new coordinate system and translating the wafer and the polishing pad to unite two coordinate systems in a new united coordinate system; calculating new coordinates and polishing frequencies of all points for a time increment ($\Delta t$) to form at least a polishing frequency; determining whether an effective wafer polishing occurs and calculating effective numbers of polishing times for all points; forming an effective polishing times matrix for the time increment $\Delta t$; and transforming the coordinate of the effective polishing times matrix back into a starting coordinate and adding all corresponding effective numbers of polishing times of each point in respective effective polishing times matrices within a total polishing time interval t on a basis of superposition.

In conclusion, the method of the present invention provides a simple way to evaluate a distribution of the effective number of polishing times in a predetermined path and a time interval by transforming drawings of a wafer and a polishing pad into binary images and implementing superposition of effective numbers of polishing times. The present invention is applicable to an analysis of effective polishing frequency and effective number of polishing times by an ordinary CMP or a compensating CMP without limitation to specific polishing pad profiles or polishing paths. Therefore, the method is advantageous to designing more practical polishing pad profiles.

It is to be understood that both the foregoing general description and the following detailed description are by examples and are intended to provide further explanation of the invention as claimed.

BRIEF DESCRIPTION OF THE DRAWINGS

These and other features, aspects and advantages of the present invention will become better understood with regard to the following description, appended claims and accompanying drawings where:

FIG. 2A is a flow chart of redefining the coordinate in accordance with a preferred embodiment of the present invention;

FIG. 2B is a flow chart of forming an effective polishing times matrix in accordance with a preferred embodiment of the present invention;

FIG. 6 is a table of parameters used in the embodiment of the present invention.

DESCRIPTION OF THE PREFERRED EMBODIMENTS

The method of the present invention analyzes distributions of an effective polishing frequency and an effective number of polishing times for a wafer with various polishing pad profiles and utilizes a numeric mode of a designed profile through an image process to fulfill the analysis. Regardless of the pattern of the polishing pad, the effective polishing frequency and the effective number of polishing times are evaluated for a wafer with different polishing pad profiles by a polishing pad numeric matrix.

The polishing frequency in the invention is defined as follows. An effective polishing refers to an actual contact between the wafer and the polishing pad. Abrasive particles are assumed to be uniformly spread on the polishing pad and the diameters of the abrasive particles are assumed not to change after contacting the wafer. The number of abrasive particles passing a position on the wafer per unit time is defined as the polishing frequency, expressed as F(i,j), which represents the relative speed between the wafer and the polishing pad divided by the original particle diameter of the abrasive.

The number of polishing times for each point on the wafer is defined as the total amount of abrasive particles passing the point within a time interval. For example, during contact between the wafer and the polishing pad, the number of polishing times is taken to be one when one abrasive particle passes a point on the wafer surface.

Figure 1A:
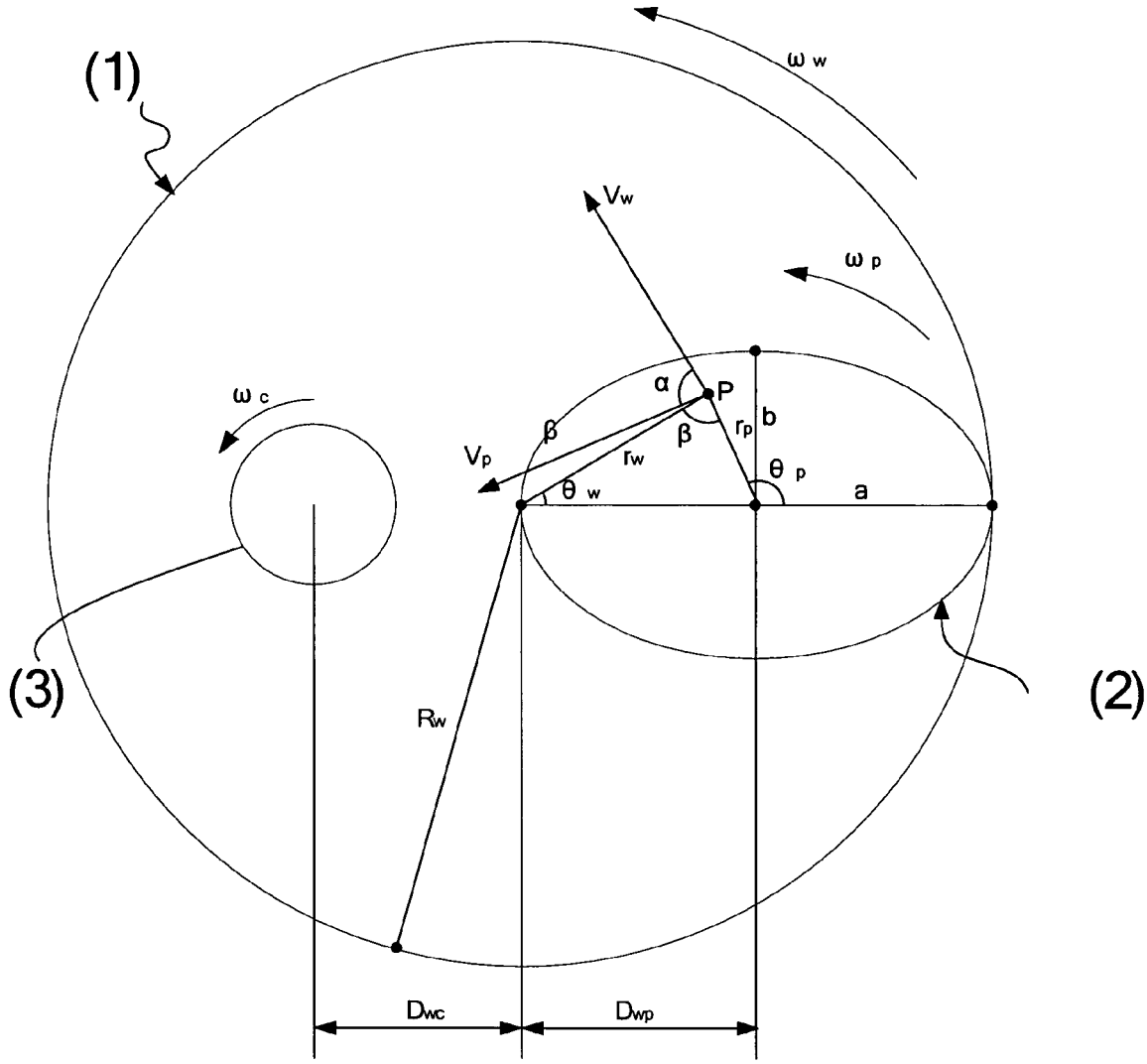
FIG. 1A is a schematic view of a compensating CMP system.

Reference will now be made in detail to the present preferred embodiments of the invention, examples of which are illustrated in the accompanying drawings. Wherever possible, the same reference numbers are used in the drawings and the description to refer to the same or like parts. It should be noted that, in all figures, reference number (1) denotes a wafer, reference number (2) denotes a polishing pad and reference number (3) denotes a compensating polishing head. FIG. 1A shows a compensating chemical mechanical planarization system. In the figure, the polishing pad (2) and the compensating polishing head (3) are all situated above the wafer (1).

Figure 2:
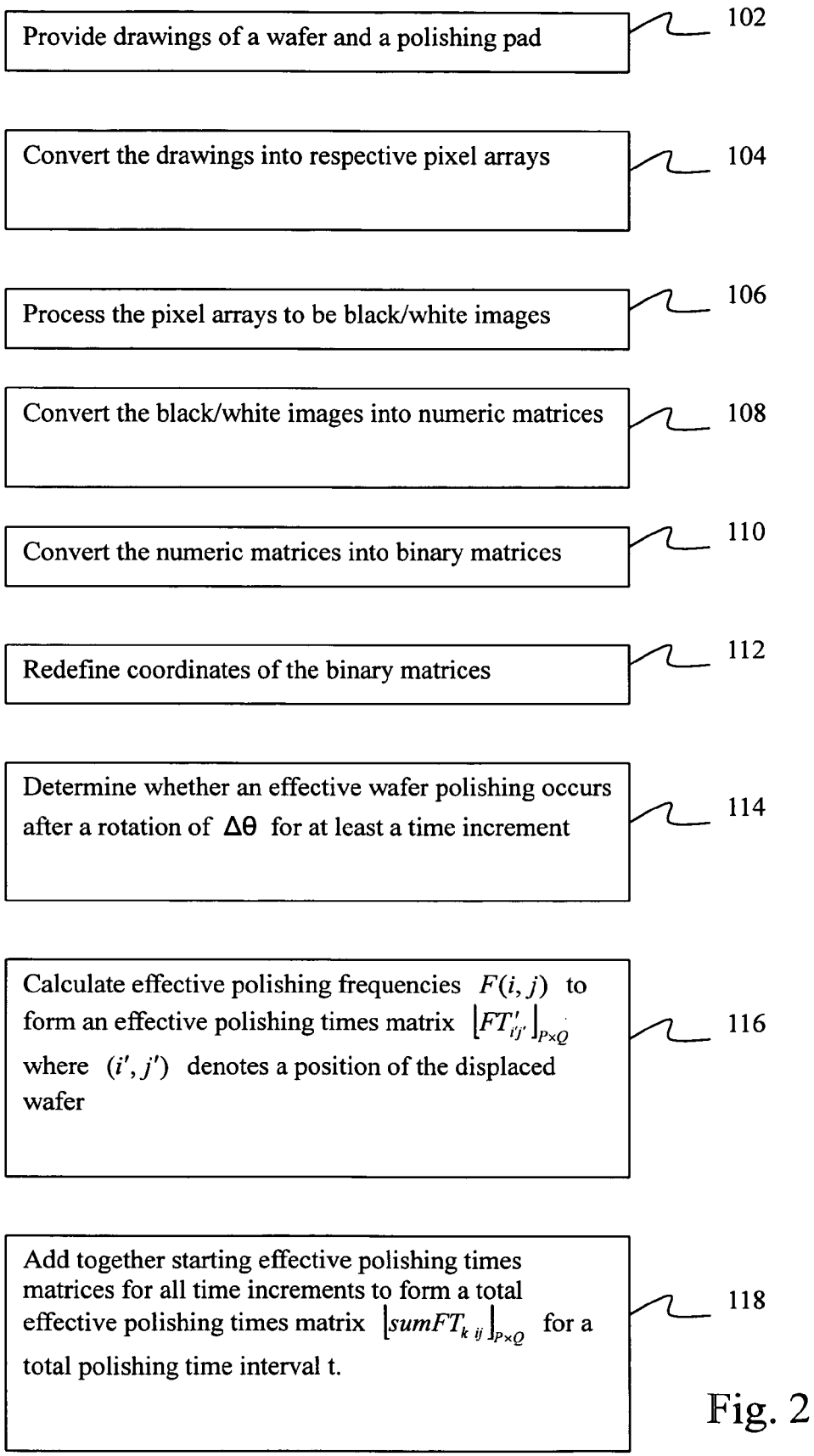
FIG. 2 is a flow chart of a method for analyzing an effective polishing frequency and an effective number of polishing times in accordance with a preferred embodiment of the present invention.

FIG. 2 is a flow chart of a method for analyzing an effective polishing frequency and an effective number of polishing times in accordance with a preferred embodiment of the present invention. In the embodiment, an effective polishing frequency and an effective number of polishing times are determined for a compensating CMP with a planet polishing path and various polishing pad profiles.

A movement path of the wafer with respect to the polishing pad in the compensating CMP system is chosen to be a planet path, wherein a relative speed between the wafer and the polishing pad is determined by $U=\sqrt{R_p^2(\omega_w-\omega_p)^2\cos\theta_p^2+D_{\omega p}^2 w_p^2}$, where $(R_p,\theta_p)$ denotes a coordinate of a point on the wafer, $W_w$ and $W_p$ are rotating speeds of the wafer and the polishing pad, and $D_{wp}$ is a distance between centers of the wafer and the polishing pad.

Figure 3:
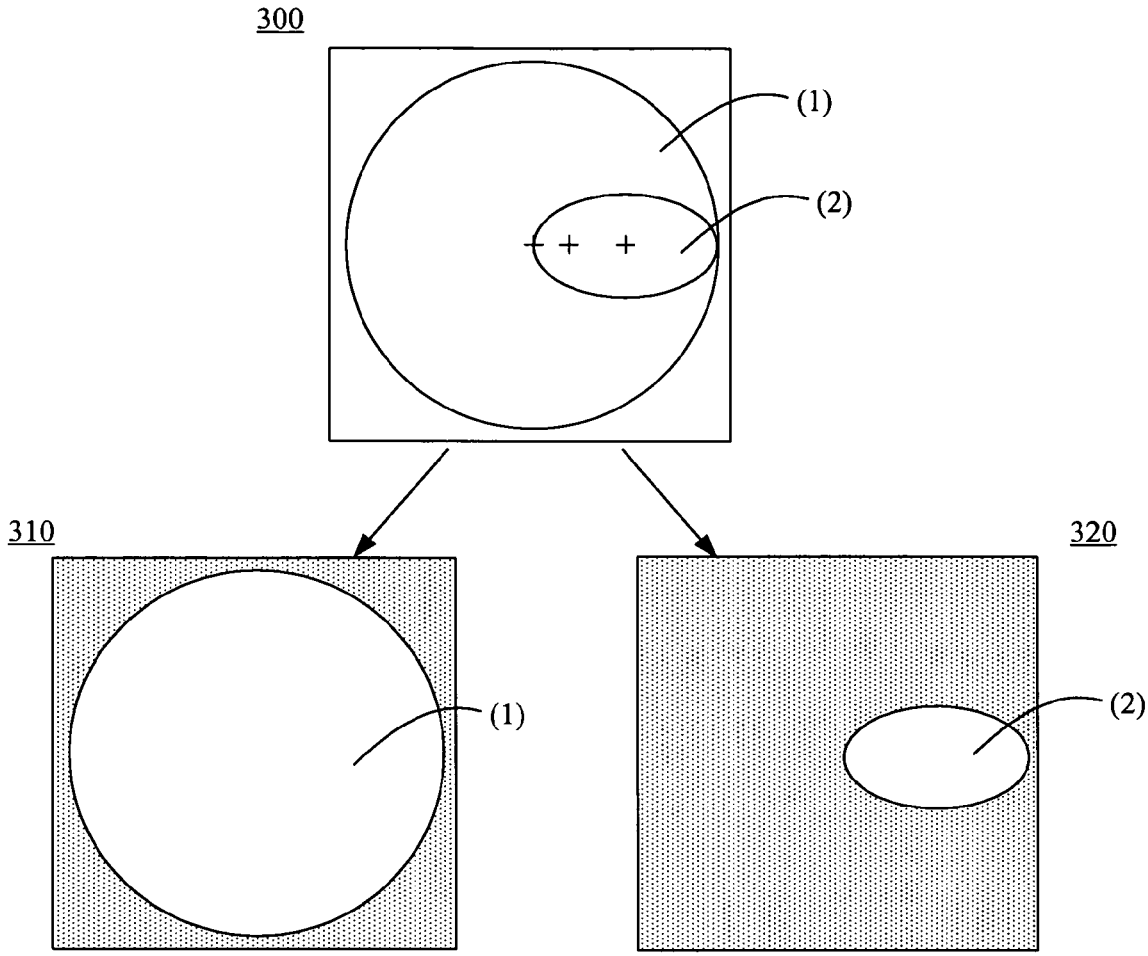
FIG. 3 is a schematic diagram of 250×250 pixel images of the wafer and the polishing pad in accordance with a preferred embodiment of the present invention.

Following the steps of FIG. 2, In a step 102, a polishing pad drawing used in a polishing process is first provided. A computer aided design (CAD) software, such as AUTOCAD®, can be employed to design a wafer drawing and the polishing pad drawing subject to actual dimensions. The profile of the polish pad may be any shape such as circular, elliptic or triangular. Reference is also made to FIG. 3, which illustrates 250×250-pixel drawings of the wafer and the polishing pad in a preferred embodiment. In the figure, a wafer and polishing pad drawing 300 is shown with an elliptic polishing pad and a circular wafer.

In a step 104, the CAD drawings are converted into images of P×Q pixel arrays, where P and Q are positive integers. An image processing software can be utilized to get converted CAD images from the CAD drawings.

In a step 106, the CAD images of the wafer and the polishing pad are converted into respective black/white images relative to the unchanged proportion of the wafer area to the polishing pad area. By the image processing software, CAD images can be processed and converted into a BMP image format. In the black/white image, white color is for image areas that material occupies, such as the wafer or the polishing pad, and black color is for image areas representing void space. In FIG. 3, a wafer black/white image 310 and a polishing pad black/white image 320 are shown.

Figure 4A:
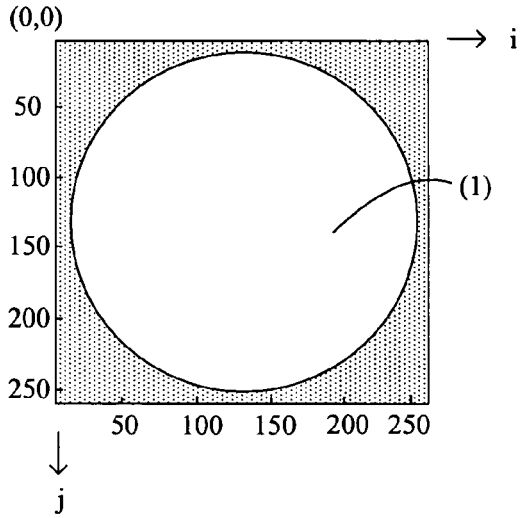
FIGS. 4A and 4B are schematic diagrams of the wafer and the polishing pad processed by an image processing software (MATLAB) in accordance with a preferred embodiment of the present invention.
Figure 4B:
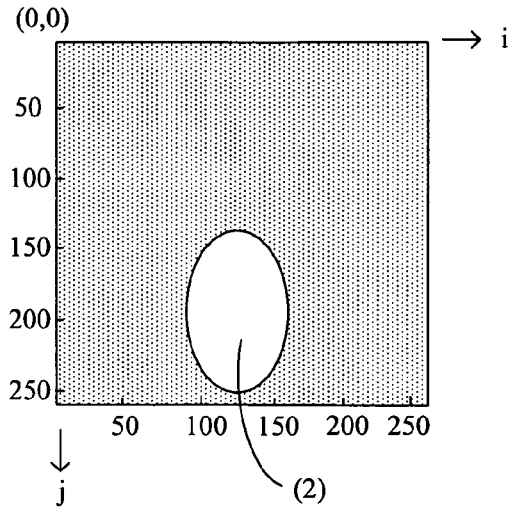

In a step 108, the black/white images are converted into numeric matrices. By the image processing software such as MATLAB®, numeric matrices can be derived from the images. Values of 255 denote points on the white area, while values of 0 denote those on the black area. After converting, the origins of the coordinates of the matrices are each located at the upper left corner individually. Reference is also made to FIGS. 4A and 4B, showing black/white images of the wafer and the polishing pad and coordinates thereof.

Figure 5A:
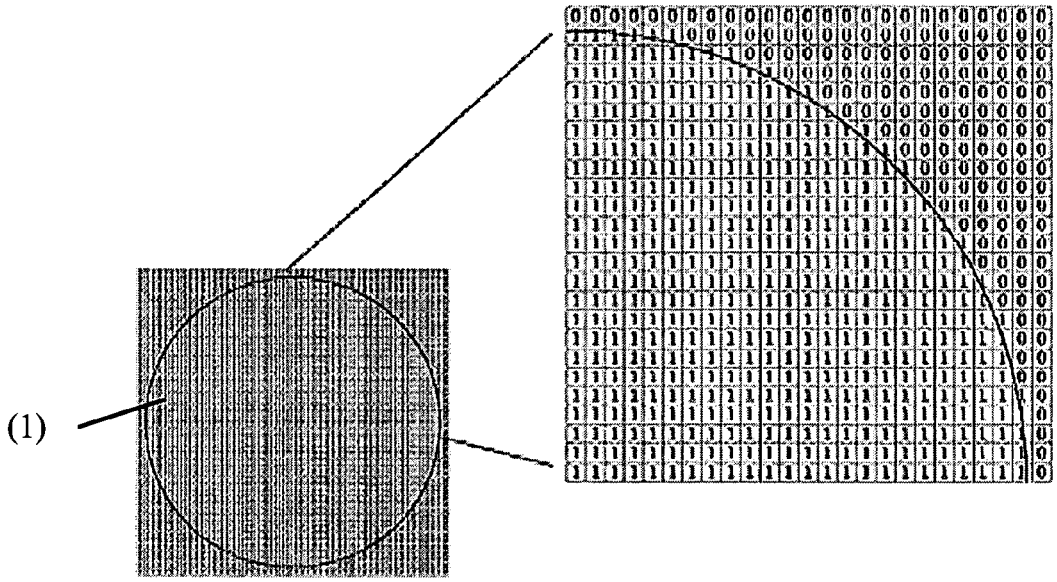
FIGS. 5A and 5B are schematic diagrams of binary matrices of the wafer and the polishing pad in accordance with a preferred embodiment of the present invention.
Figure 5B:
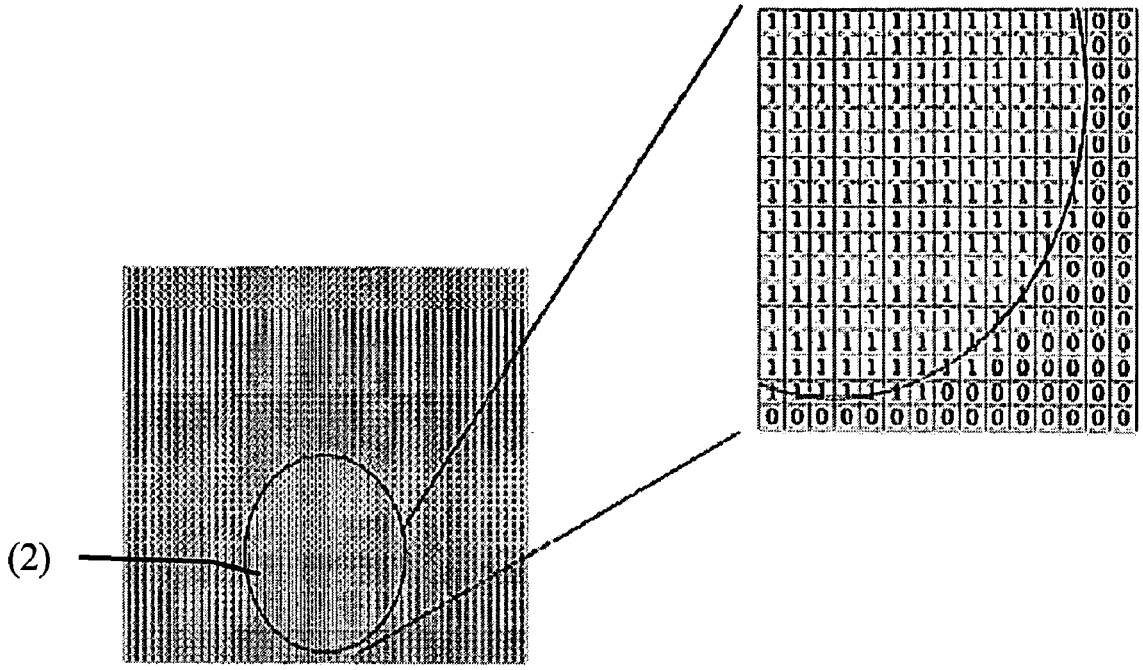

In a step 110, the numeric matrices are converted into binary matrices. By replacing all matrix values in the white area with 1 and maintaining all matrix values in the black area as 0, binary matrices of the wafer and the polishing pad are obtained. Thus, as shown in FIGS. 5A and 5B, a solid area is denoted by 1 and a void area is denoted by 0.

In a step 112, the coordinates of the binary matrices are redefined, wherein a coordinate of a matrix refers to coordinates for all elements in the matrix as a whole; for example, a new coordinate of a matrix means that each element in the matrix has a new coordinate distinguished from the old one. Referring to FIG. 2A, which illustrates a flow chart of redefining the coordinate in accordance with a preferred embodiment of the present invention, the step 112 includes a step 112*a*, setting the wafer center as an origin of a new coordinate system, (0,0), and a step 112*b*, translating the wafer and the polishing pad and redefining the coordinates of the binary matrices of the wafer and the polishing pad in terms of Cartesian coordinate by uniting two independent coordinate systems of the binary matrices into a new united coordinate system.

The method of the present invention further includes a step 114, determining a presence of an effective polishing after rotating degrees of $\Delta\theta$ for at least a time increment($\Delta t$). Because a binary matrix value of 1 means a material presence, an actual polishing occurs only when both of the polishing pad binary matrix value pad(i,j) and the wafer binary matrix value wafer(i,j) are equal to one.

Figure 1B:
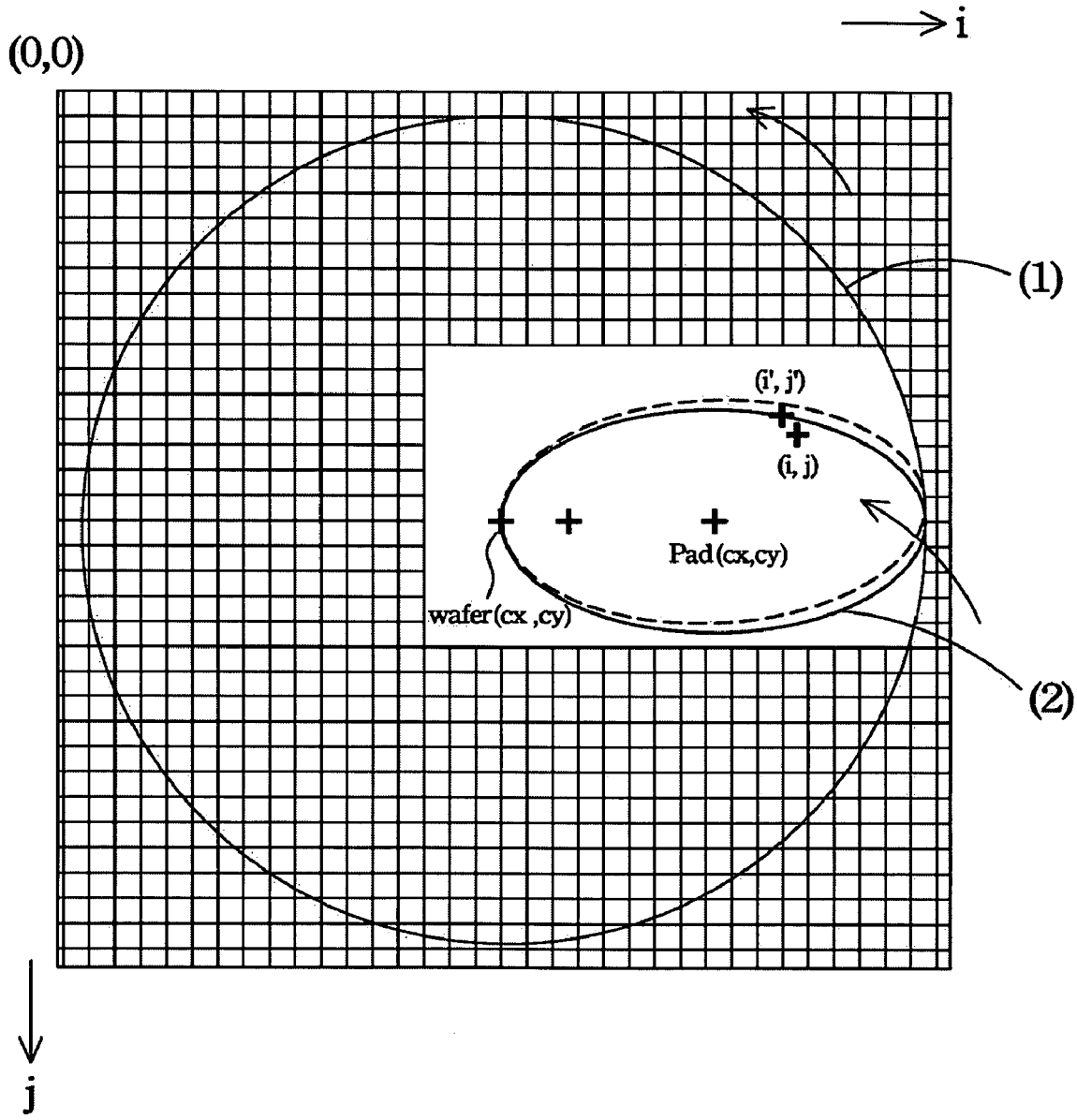
FIG. 1B is a schematic view of the coordinate transform of a matrix when a point on the polishing pad is rotated from (i,j) to (i',j') in accordance with a preferred embodiment of the present invention.

Reference is again made to FIG. 1B, which illustrates a schematic view of the coordinate transform of a matrix when a point on the polishing pad is rotated from (i,j) to (i',j') in accordance with a preferred embodiment of the present invention. When any point rotates from (i,j) to (i',j') on the basis of the wafer and the polishing pad, taking wafer(cx,cy) and pad(cx,cy)as a rotating center respectively, whether an effective polishing occurs is determined by multiplying a new wafer binary matrix value Nwafer(i',j') by a new polishing pad binary matrix value Npad(i',j'). Therefore, the effective polishing frequency matrix can be expressed as $[FF(i',j')]_{P\times Q}=[Npad(i',j')\times Nwafer(i',j')\times F(i,j)]_{P\times Q}$. When Npad(i',j')×Nwafer(i',j')=1, effective polishing occurs and when Npad(i',j')×Nwafer(i',j')=0, effective polishing is absent, where F(i,j) denotes the polishing frequency. A program for calculating the effective polishing matrix value is provided as follows.

for i=1 to P
for j=1 to Q $$FF(i',j')=Npad(i',j')\times Nwafer(i',j')\times F(i,j)$$

next j
next i

In a step 116, an effective polishing times matrix $\lfloor FT_{ij'}' \rfloor_{P\times Q}$ and an effective polishing frequency matrix for at least a time increment are formed, where (i',j') denotes a position of the displaced wafer. In the step, effective polishing frequencies of all points for a time increment $\Delta t$ are calculated and used to constitute the effective polishing times matrix. In the calculation, a movement path such as a planet path is required to derive new coordinates of the wafer binary matrix and the polishing pad binary matrix.

Also, polishing frequencies F(i,j) of all points for the time increment $\Delta t$ are determined, and the effective polishing times matrix according to the definition of the effective polishing is formed. Further, the coordinate of the effective polishing times matrix is transformed back into a starting coordinate, and the matrix with the transformed coordinate is denoted as a starting effective polishing times matrix $\lfloor FT_{k\ (ij)_k} \rfloor_{P\times Q}$.

Referring again to FIG. 2B, which shows a flow chart of forming an effective polishing times matrix in accordance with a preferred embodiment of the present invention, step 116 includes steps 116*a*~116*d*, wherein a value of a starting effective polishing times matrix for the time increment $\Delta t$ is determined. In the step 116*a*, new binary matrices of the polishing pad and the wafer for at least a time increment are determined. After the wafer and the polishing pad rotate $\Delta\theta$ about respective rotating centers, $\Delta\theta_w$ for the wafer and $\Delta\theta_p$ for the polishing pad, new binary matrices of the polishing pad and the wafer after rotating is denoted by Npad(i',j') and Nwafer(i',j'), which correspond to the binary matrices pad (i,j) and wafer(i,j), respectively.

In the step 116*b*, an effective polishing frequency and an effective number of polishing times for a point displacing from (i,j) to (i',j') is calculated and expressed as follows.

$$FT(i',j')=Npad(i',j')\times Nwafer(i',j')\times F(i,j)\times \Delta t,$$

where Npad(i',j')×Nwafer(i',j')=0 or 1, and F(i,j) is the polishing frequency. The magnitude of $\Delta t$ concerns resolution of the image, of which higher resolution means more precision.

In the step 116*c*, the effective numbers of polishing times for all points for at least a time increment are calculated to constitute an effective polishing times matrix $\lfloor FT_{i'j'}' \rfloor_{P\times Q}$, which is a $\lfloor P\times Q \rfloor$ matrix. A program to calculate the effective polishing times matrix is provided as follows:

for i=1 to P
for j=1 to Q $$FT(i',j')=Npad(i',j')\times Nwafer(i',j')\times F(i,j)\times \Delta t$$

next j
next i

In the step 116*d*, the coordinate of the effective polishing times matrix $\lfloor FT_{i'j'}' \rfloor_{P\times Q}$ for the time increment At is transformed back into a starting coordinate to obtain a starting effective polishing times matrix $\lfloor FT_{k\ (ij)_k} \rfloor_{P\times Q}$ for the time increment $\Delta t$. After transformation, each matrix takes a starting position of the rotation of the wafer as a basis, so that effective polishing times matrices for all time increments can be added together in a proper way. For example, when the wafer rotates $\Delta\theta_w$ about its rotating center in the time increment $\Delta t$, the effective polishing times matrix $\lfloor FT_{i'j'}' \rfloor_{P\times Q}$ is transformed back into the starting effective polishing times matrix $\lfloor FT_{k\ (ij)_k} \rfloor_{P\times Q}$ according to a rotating angle $-\Delta\theta_w$.

The method of the present invention further includes a step 118. The effective polishing times matrices for all time increments $\Delta t$ are added together, where the sum of all time increments $\Delta t$ is a total polishing time interval t, and then a total effective polishing times matrix $\lfloor sumFT_{k\ ij} \rfloor_{P\times Q}$ is obtained for the total polishing time interval t.

Assuming that a point rotates from $(i,j)_1$ to $(i',j')_1$ in a first time increment Δt, for a second time increment, the rotation starts with a coordinate $(i,j)_2$, which is taken to be $(i',j')_1$; and the point rotates from $(i,j)_2$ to $(i',j')_2$ during the second time increment. Then, $(i',j')_2$ is transformed back to $(i,j)_2$, as indicated in the step 116*d*. According to the same logic, for a third time increment, the point rotates from $(i',j')_2$ to $(i',j')_3$ and so on, such that incremental rotations are implemented from $(i,j)_n$ to $(i',j')_n$.

All effective polishing times matrices for individual time increments are added together to obtain a distribution of an effective number of polishing times after the total polishing time interval. Because the total polishing time interval t is a sum of all individual time increments, each starting effective polishing times matrix $\lfloor FT_{k\ ij} \rfloor_{P\times Q}$ can be superposed to obtain an effective number of polishing times for any point (i,j) on the wafer for the total polishing time interval t. The effective number of polishing times for each point (i,j) can be employed to constitute a [P×Q] matrix, which represents a total effective polishing times matrix $\lfloor sumFT_{k\ ij} \rfloor_{P\times Q}$, expressed as follows.

$$[sumFT_{kij}]_{P\times Q} = \sum_{k=1}^{n} [FT_{k(ij)k}]_{P\times Q},\ n = t/\Delta t$$

FIGS. 4A and 4B are schematic diagrams of the wafer and the polishing pad processed by an image processing software (MATLAB) in accordance with a preferred embodiment of the present invention. Values on areas of the wafer drawing and the polishing drawing are 255, while values on other areas are 0.

FIGS. 5A and 5B are schematic diagrams of binary matrices of the wafer and the polishing pad in accordance with a preferred embodiment of the present invention. It is clearly shown that numeric matrices of the wafer and the polishing pad are comprised binary digits, and any matrix value is either 0 or 1. FIG. 6 is a table of parameters used in the embodiment of the present invention.

Figure 7A:
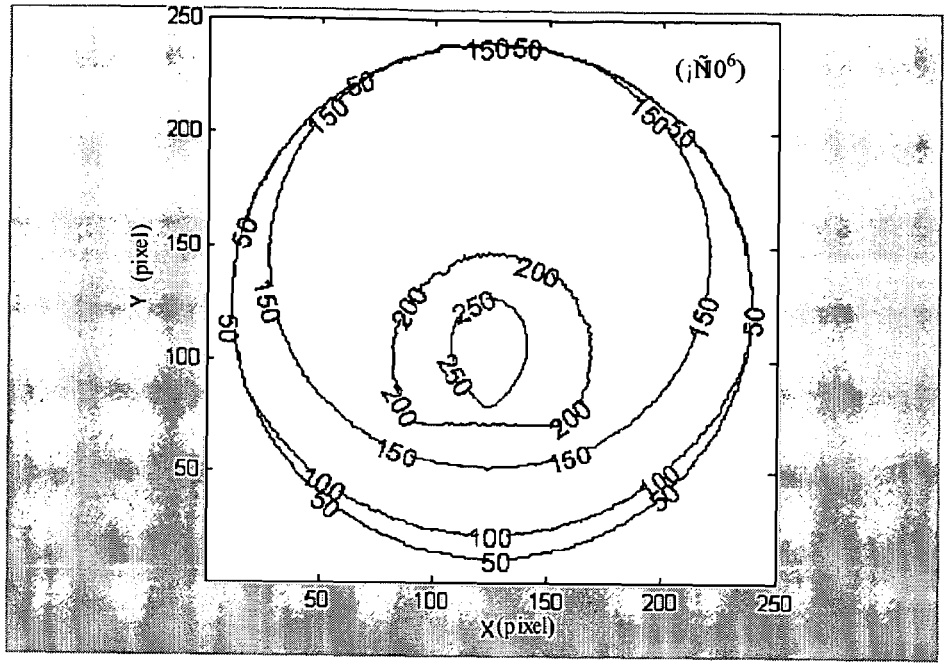
FIGS. 7A, 7B and 7C are schematic diagrams of distributions of the effective number of polishing times when the wafer is processed by a compensating CMP with circular, elliptic and triangular polishing pad.
Figure 7B:
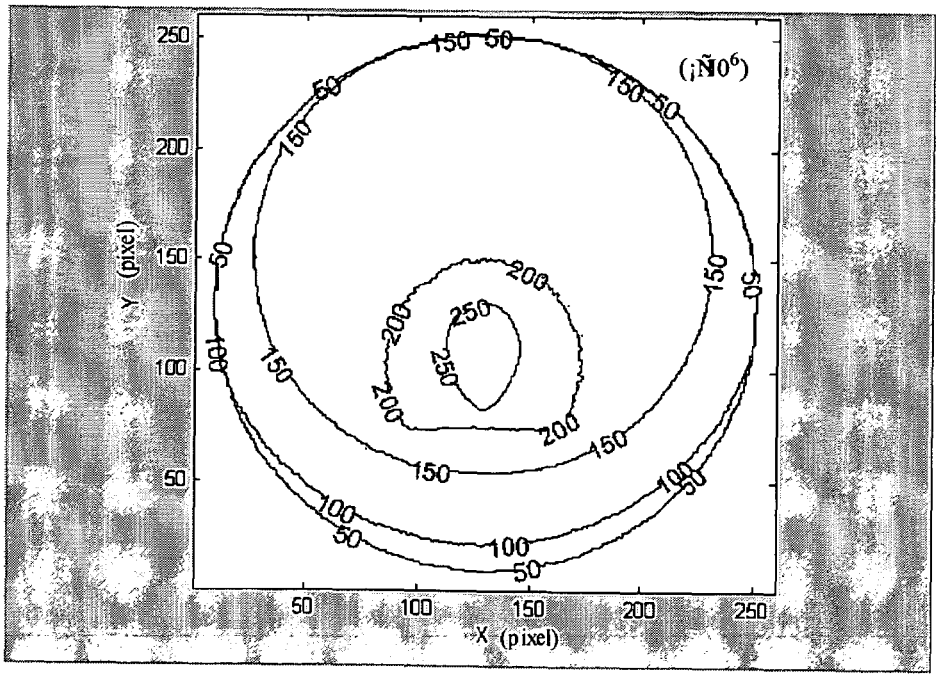
Figure 7C:
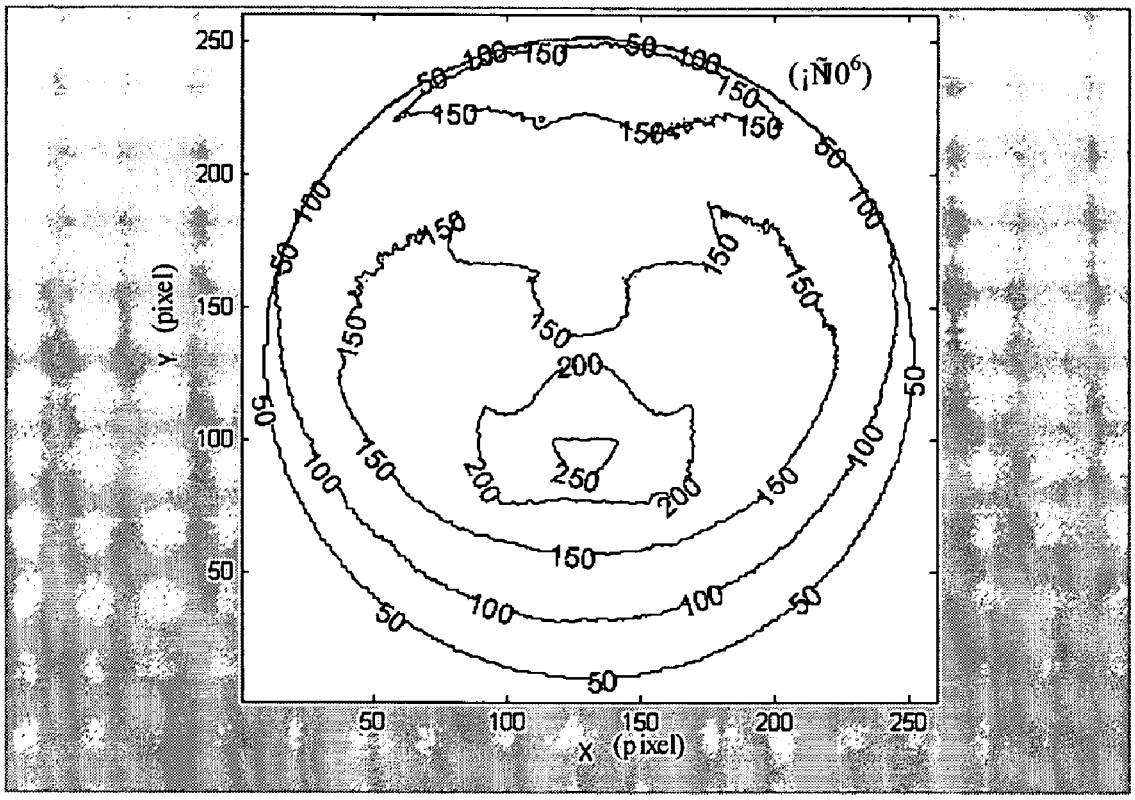

FIGS. 7A, 7B and 7C are schematic diagrams of distributions of the effective number of polishing times when the wafer is processed by a compensating CMP with each of circular, elliptic and triangular polishing pad for 180 seconds. In the figures, distributions of the effective number of the polishing times are represented as contour maps, and the area within each circle represents the wafer surface. The effective number of polishing times is $10^6$ times of the value presented at the point.

The present invention has at least the following advantage. The method of the present invention transforms drawings of the wafer and the polishing pad into the binary images and sets forth a superposition mode for the effective numbers of polishing times within a predetermined total polishing time interval. With operations of matrices, only coordinate transformation from relative motion is required, and along with superposition of effective numbers of polishing times, estimation of distribution of the effective numbers of polishing times for a wafer polished within a predetermined polishing time interval and along any polishing path is made easier.

The present invention provides a novel method for analyzing an effective polishing frequency and an effective number of polishing times for a wafer, both of which are critical factors in a CMP process. The method is applicable to an ordinary CMP as well as a compensating CMP for evaluating various distributions of effective polishing frequencies and effective polishing times for a wafer polished with different polishing pad profiles.

The present invention utilizes the CAD profile and the image process to digitize the designed models. Through CAD tools such as AUTOCAD®, images are obtained easily in terms of accurate scale and superposition of matrices is also applied to evaluate an effective polishing frequency and effective number of polishing times for the whole wafer acted upon by a newly designed polishing pad. Each binary pixel represents an affected area and the amount of pixels can be raised or lowered according to the precision demand.

The analyzing method of the present invention is not limited to specific polishing pad profiles; a polishing pad with any shape or appearance as well as any polishing path can be considered for the profile design instead. For example, a polishing pad may be circular, elliptic, triangular or any other shape without grooves on it. Therefore, the polishing frequency and polishing times in any region of the wafer surface is available for reference to wafer planarization and endpoint detection.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for analyzing polishing frequency and polishing times, applied to an analysis of effective polishing frequencies and effective numbers of polishing times for a chemical mechanical wafer polishing, comprising:

providing drawings of a polishing pad and a wafer;

converting the drawings into respective pixel arrays;

processing the pixel arrays to be black/white images;

converting the black/white images into numeric matrices;

converting the numeric matrices into binary matrices;

redefining coordinates of the binary matrices; and forming an effective polishing frequency matrix $[FF(i',j')]_{P\times Q}$ and an effective polishing times matrix $\lfloor FT_{ij'}' \rfloor_{P\times Q}$ for at least a time increment Δt, wherein (i',j') denotes a displaced wafer position.

2. The method of claim 1, wherein the drawings are produced by a computer aided design (CAD) software.

3. The method of claim 1, wherein the drawing of the polishing pad is circular, elliptic, or triangular.

4. The method of claim 1, wherein the step of converting the drawings and the step of converting the pixel arrays are implemented by an image processing software.

5. The method of claim 1, wherein of the black/white images, a black area represents absence of a material and a white area represents presence of a material.

6. The method of claim 1, wherein the step of converting the black/white images is implemented by an image processing and analyzing software.

7. The method of claim 1, wherein in the binary matrices, a matrix value of one denotes presence of a material and a matrix value of zero denotes absence of a material.

8. The method of claim 1, wherein the step of redefining coordinates comprises:

setting a center of the wafer as an origin of a new coordinate system; and translating the wafer and the polishing pad to unite the coordinates of the binary matrices in the new coordinate system.

9. The method of claim 1, wherein the wafer displaces along a planet path relative to the polishing pad.

10. The method of claim 1, wherein the effective polishing frequency is defined as an amount of abrasive particles passing a position on the wafer per unit time, and the effective number of polishing times is defined as a total amount of the abrasive particles passing the position on the wafer within a time interval.

11. The method of claim 1, wherein the step of forming comprises:

calculating new wafer binary matrix values Nwafer(i',j') and new polishing pad binary matrix values Npad(i',j') for the at least a time increment;

calculating an effective polishing frequency for a point displacing from (i,j) to (i',j'), expressed as $$FF(i',j')=Npad(i',j')\times Nwafer(i',j')\times F(i,j);\text{ and}$$

calculating an effective number of polishing times for a point displacing from (i,j) to (i',j'), expressed as $$FT(i',j')=Npad(i',j')\times Nwafer(i',j')\times F(i,j)\times\Delta t,$$

where i, j , i' and j' are positive integers, F(i,j) is a polishing frequency.

12. The method of claim 11, wherein the effective polishing frequency matrix is expressed as $$[FF(i',j')]=[Npad(i',j')\times Nwafer(i',j')\times F(i,j)]_{P\times Q},$$

and the effective polishing frequency FF(i',j') is programmed as for i=1 to P for j=1 to Q $$FF(i',j')=Npad(i',j')\times Nwafer(i',j')\times F(i,j)$$

next j next i.

13. The method of claim 11, wherein the polishing frequency F(i,j) is determined by a formula:

the polishing frequency=a relative speed between the wafer and the polishing pad divided by an original diameter of an abrasive particle.

14. The method of claim 11, further comprising determining whether an effective polishing occurs, wherein when the new wafer binary matrix value Nwafer(i',j')×the new polishing pad binary matrix value Npad(i',j')=1, the effective polishing occurs, and when the new wafer binary matrix value Nwafer(i',j')×the new polishing pad binary matrix value Npad(i',j')=0, the effective polishing is absent, where i' and j' are positive integers.

15. The method of claim 11, wherein the effective polishing times matrix is expressed as $\lfloor FT_{i'j'}\rfloor_{P\times Q}$ and the effective polishing frequency $\lfloor FT_{i'j'}\rfloor_{P\times Q}$ is programmed as for i=1 to P for j=1 to Q $$FT(i',j')=Npad(i',j')\times Nwafer(i',j')\times F(i,j)\times\Delta t$$

next j next i.

16. The method of claim 15, wherein the step of forming further comprises:

transforming a coordinate of the effective polishing times matrix $\lfloor FT_{i'j'}\rfloor_{P\times Q}$ for the at least one time increment into a starting coordinate to obtain a starting effective polishing times matrix $\lfloor FT_{k\ (ij)_k}\rfloor_{P\times Q}$ for the at least one time increment.

17. The method of claim 16, further comprising:

adding together all of the starting effective polishing times matrices $\lfloor FT_{k\ (ij)_k}\rfloor_{P\times Q}$ for the at least one time increment Δt within a total polishing time interval t to obtain a total effective polishing times matrix $\lfloor sumFT_{k\ ij}\rfloor_{P\times Q}$ for the total polishing time interval t, expressed as $$[sumFT_{kij}]_{P\times Q}=\sum_{k=1}^{n}[FT_{k(ij)_k}]_{P\times Q},\ n=t/\Delta t.$$

* * * * *